US006301785B1

(12) United States Patent
Kwiecien et al.

(10) Patent No.: US 6,301,785 B1
(45) Date of Patent: Oct. 16, 2001

(54) SHAVING AID STRIP FOR RAZOR CARTRIDGE

(75) Inventors: Michael J. Kwiecien, Scituate; Thilivhali T. Ndou, Framingham, both of MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/506,628

(22) Filed: Feb. 18, 2000

(51) Int. Cl.[7] ..... B65B 21/40
(52) U.S. Cl. ..... 30/41; 30/81; 30/50; 424/73
(58) Field of Search ..... 30/34.05, 41, 50, 30/80, 81, 77; 424/73

(56) References Cited

U.S. PATENT DOCUMENTS

| | | | | |
|---|---|---|---|---|
| 4,850,106 | | 7/1989 | Braun et al. | 30/41 |
| 4,872,263 | * | 10/1989 | Etheredge, III | 30/41 |
| 5,095,619 | * | 3/1992 | Davis et al. | 30/41 |
| 5,113,585 | | 5/1992 | Rogers et al. | 30/41 |
| 5,345,680 | * | 9/1994 | Vreeland et al. | 30/41 |
| 5,430,939 | | 7/1995 | Johnston | 30/41 |
| 5,454,164 | | 10/1995 | Yin et al. | 30/41 |
| 5,626,154 | | 5/1997 | Rogers et al. | 30/41 |
| 5,713,131 | | 2/1998 | Rogers et al. | 30/41 |
| 5,956,848 | | 9/1999 | Tseng et al. | 30/41 |
| 5,956,849 | | 9/1999 | Chadwick et al. | 30/41 |
| 6,185,822 | * | 2/2001 | Tseng et al. | 30/41 |

FOREIGN PATENT DOCUMENTS

| | | |
|---|---|---|
| 693528 | 1/1996 | (EP) . |
| 8-280952 | 10/1996 | (JP) . |
| WO 96/13360 | 5/1996 | (WO) . |

OTHER PUBLICATIONS

TONE® Polymers, Union Carbide brochure, © 1990, 1994.

* cited by examiner

*Primary Examiner*—Hwei-Siu Payer
(74) *Attorney, Agent, or Firm*—Stephan P. Williams

(57) ABSTRACT

The present invention is directed to a solid polymeric shaving aid strip for a razor cartridge. The shaving aid strip comprises a lubricious water-soluble polymer and a polycaprolactone, and optionally a water-insoluble polymer. It has been found that polycaprolactone improves the fabrication of the shaving aid strip, provides smoother strip surfaces and permits the inclusion of greater amounts of water-soluble polymer in the strip. It has also been found that a shaving aid strip which contains polycaprolactone releases more shaving aid during use and has better structural integrity and less swelling. The present invention is also directed to a razor cartridge which includes the aforementioned shaving aid strip.

9 Claims, 1 Drawing Sheet

SHAVING AID STRIP FOR RAZOR CARTRIDGE

BACKGROUND OF THE INVENTION

This invention relates to a shaving aid strip (or composite) for a razor cartridge.

It is now well known that shaving comfort can be enhanced by affixing to a razor cartridge a shaving aid composite, also known as a lubricating strip, which continuously releases a shaving aid, typically a lubricant, during the shaving process. See, for example, U.S. Pat. No. 4,170,821 and GB 2,024,082. The shaving aid strip generally comprises a water-insoluble polymer matrix, typically polystyrene, and a water-soluble shaving aid, typically polyethylene oxide, which leaches out of the strip during shaving to enhance shave comfort.

Unfortunately, conventional shaving aid strips suffer from the disadvantage that they release an insufficient amount of the shaving aid, particularly after the first four or five shaves where release of the shaving aid may drop off to negligible quantities. In addition, the amount of shaving aid that may be included in the shaving aid strip may be limited because high levels of shaving aid are difficult to process and can adversely affect the structural integrity of the strip. Accordingly, recent efforts have been made to improve shaving aid strips so as to enhance and prolong release of the shaving aid.

Such efforts have resulted in improved shaving aid strips which include the following features: incorporation of a low molecular weight release enhancing agent, such as polyethylene glycol, into the matrix (U.S. Pat. No. 5,113,585); the use of ethylene vinyl acetate copolymer as the matrix material (U.S. Pat. No. 5,349,750); incorporation of a compatibilizer material such as polyethylene oxide-polypropylene oxide copolymer (e.g. Poloxamer 182) (U.S. Pat. No. 5,454,164); incorporation of a water-swellable polymer such as Salsorb 84, a cross-linked polyacrylic (U.S. Pat. No. 5,626,154); coextrusion of a core comprising a water-leachable shaving aid within a sheath of water-insoluble polymer, wherein the sheath has a plurality of openings to facilitate release of the shaving aid (WO 96/13360, which corresponds to U.S. Ser. No. 08/497,194); and coextrusion of adjacent shaving aid portions (U.S. Pat. No. 5,956,848). Also known are shaving aid strips which include an essential oil (U.S. Pat. No. 5,095,619) or a non-volatile cooling agent (U.S. Pat. No. 5,713,131), and injection molded strips which include a plasticizer (U.S. Pat. No. 4,850,106). All of the aforementioned patents or published applications are incorporated herein by reference.

SUMMARY OF THE INVENTION

The present invention is directed to a solid polymeric shaving aid strip for a razor cartridge. The shaving aid strip comprises a lubricious water-soluble polymer and a polycaprolactone. Preferably, the strip may also optionally contain a water-insoluble polymer, which serves as a matrix in which the water-soluble polymer is incorporated (or dispersed). It has been found that polycaprolactone improves the fabrication of the shaving aid strip, provides smoother strip surfaces and permits the inclusion of greater amounts of water-soluble polymer in the strip. It has also been found that a shaving aid strip which contains polycaprolactone releases more shaving aid during use and has better structural integrity and less swelling. The present invention is also directed to a razor cartridge which includes the aforementioned shaving aid strip.

The razor cartridge will comprise a blade (one or more) and a skin-engaging portion in proximity to the blade, wherein the skin engaging portion includes the shaving aid strip. The shaving aid strip contacts the skin during shaving and releases shaving aid onto the skin. The shaving aid strip is typically located at the rear (or cap) portion of the cartridge (i.e. behind the blade or blades), but may also be located at the front (or guard) portion of the cartridge (i.e. in front of the blade or blades), or a shaving aid strip may be placed at both positions on the cartridge. The razor cartridge is generally affixed to a handle for use in shaving. The razor cartridge may be designed to be removably affixed to a handle in the case of razor systems in which the handle is reused and the cartridge is disposed of after one or more uses. Or the razor cartridge may be permanently affixed to a handle (or integral with the handle) in the case of disposable razors in which the handle and cartridge are disposed of together as a unit after one or more uses. The term razor cartridge is thus intended to apply to both types of cartridge.

DETAILED DESCRIPTION OF THE INVENTION

Figure 1:
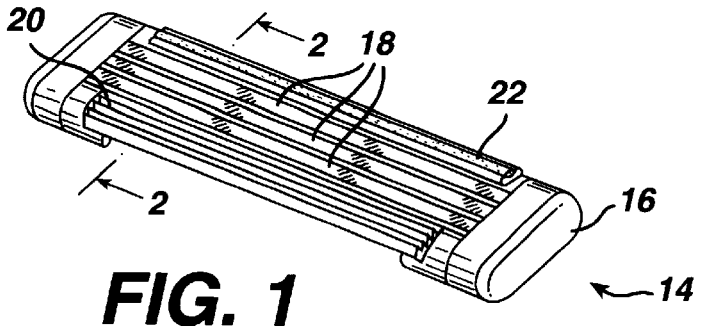
FIG. 1 is a perspective view of a razor cartridge which includes a shaving aid strip of the present invention.
Figure 2:
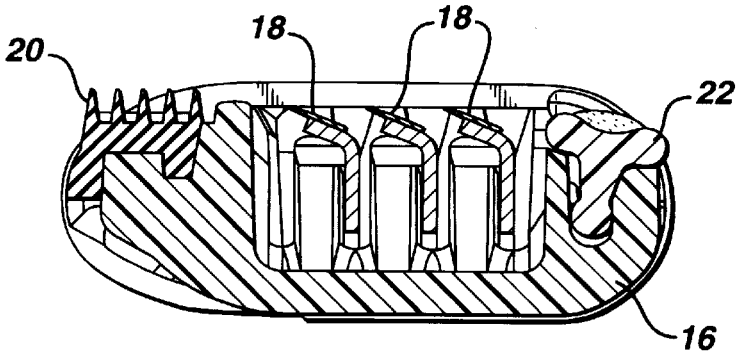
FIG. 2 is a sectional view taken along line 2—2 of FIG. 1.

Referring to FIGS. 1 and 2, the razor cartridge 14 includes housing 16, which carries three blades 18, a finned elastomeric guard 20, and a solid polymeric shaving aid strip 22 located on a skin-engaging portion (in this case the cap) of the cartridge. The shaving aid strip (or composite) is locked in an opening in the rear of the cartridge and includes a lubricious water-soluble polymer shaving aid that is released by the strip during shaving to improve shave attributes. While shown at the rear portion of this particular razor cartridge, the shaving aid strip may be located at any skin-engaging portion of the cartridge and may be fabricated in any size or shape deemed appropriate. For example, the strip can be incorporated into razor cartridges such as the Mach 3®, Sensor Excel®, Atra Plus® and Custom Plus® razors sold by The Gillette Company, as well as in other commercial razor cartridges.

Figure 3:
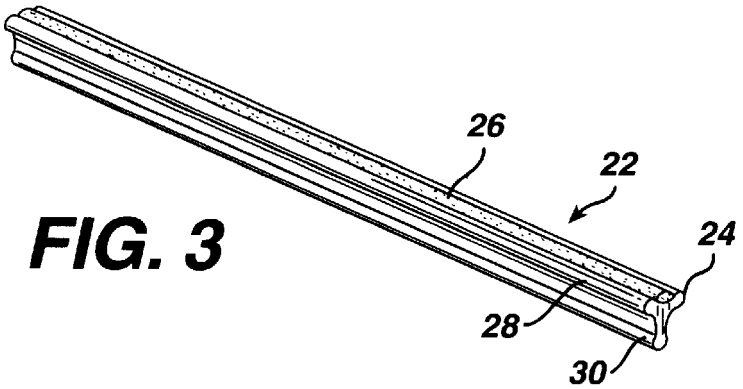
FIG. 3 is a perspective view of the shaving aid strip included in the razor cartridge depicted in FIG. 1.
Figure 4:
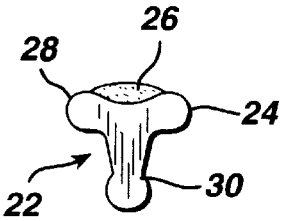
FIG. 4 is a side elevation view of the shaving aid strip of FIG. 3.

Referring to FIGS. 3 and 4, shaving aid strip 22 includes three exposed lengthwise-extending portions 24, 26, and 28, each in the shape of a rounded lobe with a lengthwise-extending exposed surface. Strip 22 also includes connecting portion 30, which connects portions 24 and 28 and also optionally serves to lock the strip into a mating receiving portion of the cartridge. Portions 24 and 28 and connecting portion 30 preferably have the same composition and, together, surround all but the exposed face of portion 26 and provide support for portion 26. Portion 26 also optionally extends above portions 24 and 28 and, preferably, comprises a greater amount (in percent by weight) of shaving aid than in portions 24 and 28. The shaving aid strip typically may be about 2.5 cm to about 3.7 cm in length, and about 0.15 cm to about 0.35 cm in width.

Figure 5:
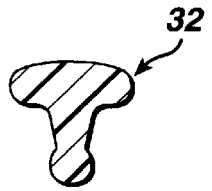
FIG. 5 is a side elevation view of second type of shaving aid strip of the present invention.
Figure 6:
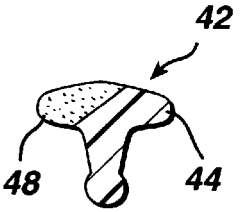
FIG. 6 is a side elevation view of third type of shaving aid strip of the present invention.
Figure 7:
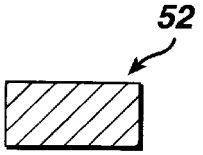
FIG. 7 is a side elevation view of fourth type of shaving aid strip of the present invention.

FIGS. 5, 6 and 7 depict alternative types of shaving aid strips. Strip 32, shown in FIG. 5, is similar to strip 22, except that strip 32 has a homogeneous composition throughout and a uniform, slightly curved to flat upper surface. Strip 42, shown in FIG. 6, is also similar to strip 22, except that strip 42 has only two lengthwise extending portions 44 and 48, each in the shape of a rounded lobe. The portion 48 preferably is larger than portion 44 and extends above portion 44, and also preferably comprises a greater amount (in percent by weight) of shaving aid than portion 44. Strip 52, shown in FIG. 7, has a rectangular cross-section and a homogeneous composition throughout. Such a strip may be glued or ultrasonically welded to a razor cartridge. This type of strip may also be fabricated in a wedge-shaped cross-section (not shown) or any other desired shape. Shaving aid strips may also be constructed in two or more layers, such as a sandwich or a sheath/core construction (see, for example, WO 96/01172 and WO 96/13360).

The shaving aid strip, or at least one portion thereof, will include a lubricious water-soluble polymer and a polycaprolactone. The strip will also optionally (and preferably) include a water-insoluble polymer to serve as a matrix in which the water-soluble polymer is dispersed.

Sufficient water-soluble polymer should be included in the shaving aid strip to provide the desired lubrication benefit. The strip, or a portion thereof, may preferably contain, for example, about 50% to about 95%, more preferably about 55% to about 90%, most preferably about 60% to about 85% by weight of a lubricious water-soluble polymer.

Typical lubricious water-soluble polymers include polyethylene oxide, polyvinyl pyrrolidone, polyacrylamide, modified hydroxyalkyl cellulose, polyvinyl imidazoline, polyvinyl alcohol, polysulfone, and polyhydroxyethylmethacrylate.

The preferred lubricious water-soluble polymer is polyethylene oxide. The more preferred polyethylene oxides generally are known as POLYOX (available from Union Carbide Corporation) or ALKOX (available from Meisei Chemical Works, Kyoto, Japan). These polyethylene oxides will preferably have molecular weights of about 100,000 to 8 million daltons, most preferably about 300,000 to 5 million daltons. It is preferred to use a blend of polyethylene oxides, typically a blend having at least one polyethylene oxide having a molecular weight in the range of 100,000 to 500,000 and at least one polyethylene oxide having a molecular weight in the range of 3 million to 8 million. The most preferred polyethylene oxide comprises a blend of about 40% to 80% by weight of polyethylene oxide having an average molecular weight of about 5 million (e.g. POLYOX COAGULANT) and about 60% to 20% of polyethylene oxide having an average molecular weight of about 300,000 (e.g. POLYOX WSR-N-750). A 60:40 blend of these two polyethylene oxides (5 million:300,000) is especially preferred.

Sufficient polycaprolactone should be included in the shaving aid strip to provide the desired benefit, which may include one of more of the following improvements over conventional strips: improved fabrication, smoother strip surface, greater water-soluble polymer content, improved shaving aid release, better structural integrity and less swelling. The strip, or a portion thereof, may preferably contain, for example, about 0.5% to about 50%, more preferably about 1% to about 20%, most preferably about 1% to about 10% by weight of a polycaprolactone.

Polycaprolactones are available from Union Carbide Corporation under the name TONE® polymers (e.g., P-737, P-767, P-787 and Polyol 1270). These polycaprolactones include homopolymers of ϵ-caprolactone, which have the structure $H—[—O—(CH_2)_5—C(O)—]_n—OH$, and diol or triol modified polycaprolactones, which have the structure $H—[—O—(CH_2)_5—C(O)—]_m—O—R—O—[—C(O)—(CH_2)_5—O—]_n—H$ in which R is an aliphatic hydrocarbon, preferably derived from a lower alkyl diol such as 1,4-butanediol, and m and n are integers. Preferably, the polycaprolactone will have a molecular weight (number average) between about 1000 and about 80,000 daltons, more preferably between about 30,000 and 60,000 daltons, and most preferably about 50,000 daltons. The polycaprolactonehomopolymers are preferred.

The shaving aid strip, or a portion thereof, will also optionally (and preferably) include a water-insoluble polymer to serve as a matrix in which the water-soluble polymer is dispersed. Preferably, the strip or any portion will include about 0% to about 50%, more preferably about 5% to about 40%, and most preferably about 15% to about 35% by weight of the water-insoluble polymer. Suitable water-insoluble polymers which can be used include polyethylene, polypropylene, polystyrene, butadiene-styrene copolymer (e.g. medium and high impact polystyrene), polyacetal, acrylonitrile-butadiene-styrene copolymer, ethylene vinyl acetate copolymer, polyurethane, and blends thereof such as polypropylene/polystyrene blend or polystyrene/impact polystyrene blend.

The more preferred water-insoluble polymer is polystyrene, preferably a general purpose polystyrene, such as NOVA C2345A, or a high impact polystyrene (i.e. polystyrene-butadiene), such as BASF 495F KG21. The strip or any portion should contain a sufficient quantity of water-insoluble polymer to provide adequate mechanical strength, both during production and use.

Thus, shaving aid strips of the present invention will typically include 50% to 95%, preferably 55% to 90%, lubricious water-soluble polymer (preferably polyethylene oxide), 0.5% to 50%, preferably 1% to 20%, polycaprolactone (preferably molecular weight of 30,000 to 60,000 daltons), and 0% to 50%, preferably 5% to 40%, water-insoluble polymer (preferably polystyrene or impact polystyrene).

The shaving aid strip, or any portion, also may contain other conventional shaving aid ingredients, such as low molecular weight water-soluble release enhancing agents such as polyethylene glycol (MW<10,000, e.g., 1–10% by weight PEG-100), water-swellable release enhancing agents such as cross-linked polyacrylics (e.g., 2–7% by weight), colorants, antioxidants, preservatives, vitamin E, aloe, cooling agents, essential oils, beard softeners, astringents, medicinal agents, etc. Portions that contain a colorant can be designed to release the colorant (e.g., by leaching or abrasion), and thereby cause the strip to change color during shaving, preferably in response to wear of the colored portion, so as to provide an indication to the user that the shaving aid strip and/or the razor cartridge has reached the end of its effective life or the end of its optimum performance. A portion may contain, for example, between about 0.1% and about 5.0% (preferably between about 0.5% and 3%) colorant by weight.

Shaving aid strips of the present invention may be fabricated by any appropriate method, including injection molding and extrusion, the latter being preferred. All of the components of the strip are blended prior to molding or extrusion. For best results, it is preferred that the components are dry.

The blended components may be extruded through a Haake System 90, ¾ inch diameter extruder with a barrel pressure of about 1000–2000 psi, a rotor speed of about 10 to 50 rpm, and a temperature of about 150°–185° C. and a die temperature of about 170°–185° C. Alternatively, a 1¼ inch single screw extruder may be employed with a processing temperature of 175°–200° C., preferably 185°–190°C., a screw speed of 20 to 50 rpm, preferably 25 to 35 rpm, and an extrusion pressure of 1800 to 5000 psi, preferably 2000 to 3500 psi. The extruded strip is air cooled to about 25° C. To injection mold the strips it is preferred to first extrude the powder blend into pellets. This can be done on a 1¼ or 1½ inch single screw extruder at a temperature of 120°–180° C., preferably 140°–150° C., with a screw speed of 20 to 100 rpm, preferably 45 to 70 rpm. The pellets are then molded in either a single material molding or multi-material molding machine, which may be single cavity or multi-cavity, optionally equipped with a hotrunner system. The process temperature can be from 165° to 250° C., preferably from 180° C. to 225° C. The injection pressure should be sufficient to fill the part completely without flashing. Depending on the cavity size, configuration and quantity, the injection pressure can range from 300 to 2500 psi. The cycle time is dependent on the same parameters and can range from 3 to 30 seconds, with the optimum generally being about 6 to 15 seconds.

The invention may be further described by the following examples in which all parts and percentages are by weight.

EXAMPLES 1 TO 5

Shaving aid strips with a cross-section like that of strip 32 shown in FIG. 5 are fabricated from the blends of components indicated below by extruding the blends through a Haake System 90, ¾ inch diameter extruder with a barrel pressure of about 1000–2000 psi, a rotor speed of about 10 to 50 rpm, and a temperature of about 150°–185° C. and a die temperature of about 170°–185° C. The extruded strips are cooled and sliced to appropriate lengths for securing into razor cartridges like cartridge 14. Four different polycaprolactones are alternatively used in each example.

| | Weight Percent | | | | |
|---|---|---|---|---|---|
| Component | Ex. 1 | Ex. 2 | Ex. 3 | Ex. 4 | Ex. 5 |
| Polyethylene oxide [1] | 60.0 | 60.0 | 63.0 | 75.0 | 58.5 |
| Polystyrene [2] | | | | | 10.5 |
| High Impact Polystyrene [3] | 31.5 | 28.5 | 20.5 | | 19.5 |
| PEG-100 | 5.0 | 5.0 | 5.0 | | 5.0 |
| Color [4]/Preserv. | 1.5 | 1.5 | 1.5 | 1.0 | 1.5 |
| Polycaprolactone [5] | 2.0 | 5.0 | 10.0 | 25.0 | 5.0 |

[1] 60:40 blend of Coagulant:WSR-N-750 (mol. wt. 5 million:300,000)
[2] Nova C2345A
[3] BASF 495F KG21
[4] Color concentrate contains 65–95% polystyrene
[5] Tone ® P-767, P-737, polyol 1270, or P-787 (Union Carbide)

EXAMPLES 6 AND 7

Shaving aid strips with a cross-section like that of strip 22 shown in FIG. 4 are fabricated from the blends of components indicated below (four different polycaprolactones are alternatively used in each example) by coextruding the blends in the following manner. The components for each portion (portion 26 and portion 24, 28, 30) may be supplied by two separate melting/pumping (plastics extruders), each consisting of a heated barrel, a pumping screw, a motor drive for that screw and a control system for the entire system. The materials are fed in powder form into their respective extruders (e.g., single screw type manufactured by Davis Standard). The extruders can operate at the same or different speeds and the same or different temperatures. The barrel temperature for each extruder can be ramped in three zones from 165° C. to 190° C.; a fourth heater at the die/barrel connection can also be set to 190° C., and a fifth heater at the die can range from 190° C. to 205° C. Via rugged weldments the molten streams of the components are brought together to form the strip. Portion 26 can be precisely located on a portion (combination of 24, 28, and 30) through accurately machined pathways in the die head. Because they have different compositions, the two molten materials are brought together at the last possible moment before exiting the die. Both materials exit the die head in a size and shape approximating that of the final product. The final dimensions are achieved using a series of forming rollers as the extrudate is cooled. The strip is typically extruded at a rate of about 50 feet per minute. The combined molten materials are drawn from the die head into the sizing/cooling device at a constant speed such that its cross section is always constant. Under a bath of cool dry air the molten material is cooled until no longer pliable. Once cooled, the strips can be cut to the appropriate length and attached to razor cartridges like cartridge 14.

| Component | Weight Percent | | | |
|---|---|---|---|---|
| | Example 6 | | Example 7 | |
| | Portion 24, 28, 30 | Portion 26 | Portion 24, 28, 30 | Portion 26 |
| Polyethylene oxide [1] | 62.0 | 68.0 | 60.0 | 71.0 |
| H.I. Polystyrene [2] | 31.5 | 17.0 | 28.5 | 11.0 |
| PEG-100 | 5.0 | 5.0 | 5.0 | 5.0 |
| White Color [3]/Preserv. | 1.5 | | 1.5 | |
| Blue Color [3]/Preserv. | | 4.0 | | 4.0 |
| Vitamin E/aloe | | 1.0 | | 1.0 |
| Polycaprolactone [4] | | 5.0 | 5.0 | 8.0 |

[1] 60:40 blend of Coagulant:WSR-N-750 (mol. wt. 5 million:300,000)
[2] BASF 495F KG21
[3] Color concentrate contains 65–95% polystyrene
[4] Tone ® P-767, P-737, polyol 1270, or P-787 (Union Carbide)

EXAMPLES 8 AND 9

Shaving aid strips with a cross-section like that of strip 42 shown in FIG. 5 are fabricated from the blends of components indicated below (four different polycaprolactones are alternatively used in each example) by coextruding the blends in the same manner as described in Examples 6 and 7. The components for each portion (portion 44 and portion 48) are set out below. After fabrication, the strips can be cut to the appropriate length and attached to razor cartridges like cartridge 14.

| | Weight Percent | | | |
|---|---|---|---|---|
| | Example 8 | | Example 9 | |
| | Portion 44 | Portion 48 | Portion 44 | Portion 48 |
| Polyethylene oxide [1] | 60.0 | 75.0 | 55.0 | 69.0 |
| Polystyrene [2] | | 10.2 | | 13.2 |
| H.I. Polystyrene [3] | 32.5 | | 30.5 | |
| PEG-100 | 5.0 | 5.0 | 10.0 | 5.0 |
| White Color [4]/Preserv. | 1.5 | | 1.5 | |
| Blue Color [4]/Preserv. | | 4.0 | | 4.0 |
| Vitamin E | | 0.8 | | 0.8 |
| Polycaprolactone [5] | 1.0 | 5.0 | 3.0 | 8.0 |

[1] 60:40 blend of Coagulant:WSR-N-750 (mol. wt. 5 million:300,000)
[2] NOVA C2345A
[3] BASF 495F KG21
[4] Color concentrate contains 65–95% polystyrene
[5] Tone ® P-767, P-737, polyol 1270, or P-787 (Union Carbide)

While particular embodiments of the invention have been shown and described for illustrative purposes, it will be apparent to those skilled in the art that various changes and modifications may be made without departing from the spirit and scope the invention, which is defined by the claims which follow.

What is claimed is:

1. A razor cartridge comprising a blade and a skin-engaging portion in proximity to said blade, said skin-engaging portion including a solid polymeric shaving aid strip comprising 55% to 90% polyethylene oxide with a molecular weight of 100,000 to 8 million daltons, 5% to 40% water-insoluble polymer selected from polystyrene, butadiene-styrene copolymer or blends thereof, and 0.5% to 50% of a polycaprolactone.

2. The razor cartridge of claim 1 wherein said shaving aid strip comprises 1% to 20% polycaprolactone.

3. The razor cartridge of claim 2 wherein said shaving aid strip comprises 1% to 10% polycaprolactone.

4. The razor cartridge of claim 1, 2 or 3 wherein said polycaprolactone has a molecular weight between about 1000 and about 80,000 daltons.

5. The razor cartridge of claim 1, 2 or 3 wherein said polycaprolactone has a molecular weight between about 30,000 and about 60,000 daltons.

6. The razor cartridge of claim 5 wherein said polycaprolactone is polycaprolactone homopolymer.

7. The razor cartridge of claim 2 wherein said polyethylene oxide comprises a blend of at least one polyethylene oxide having a molecular weight in the range of 100,000 to 500,000 daltons and at least one polyethylene oxide having a molecular weight in the range of 3 million to 8 million daltons.

8. The razor cartridge of claim 1 or 7 wherein said shaving aid strip has a homogeneous composition throughout.

9. The razor cartridge of claim 1 or 7 wherein said shaving aid strip comprises two or three adjacent lengthwise-extending portions and one of said portions comprises more of said polyethylene oxide than the other of said portions.

* * * * *